United States Patent [19]

Heled

[11] 4,355,779

[45] Oct. 26, 1982

[54] COLLAPSIBLE STAND FOR SHEET MUSIC AND THE LIKE

[76] Inventor: Simca Heled, 211 East 70th St., New York, N.Y. 10021

[21] Appl. No.: 16,881

[22] Filed: Mar. 2, 1979

[51] Int. Cl.[3] ..... A47B 97/04

[52] U.S. Cl. ..... 248/460

[58] Field of Search ..... 248/167, 170, 454, 460, 248/462, 464

[56] References Cited

U.S. PATENT DOCUMENTS

| | | | |
|---|---|---|---|
| 714,043 | 11/1902 | Seitz | 248/170 |
| 966,250 | 8/1910 | Simkins | 248/462 |
| 2,046,134 | 6/1936 | Ryang | 248/462 X |
| 2,538,318 | 1/1951 | Mitchell | 248/455 X |
| 2,744,712 | 5/1956 | Brandt | 248/460 X |
| 3,868,085 | 2/1975 | Bentley | 248/464 |

FOREIGN PATENT DOCUMENTS

| | | | |
|---|---|---|---|
| 74075 | 5/1893 | Fed. Rep. of Germany | 248/454 |
| 412715 | 4/1925 | Fed. Rep. of Germany | 248/170 |

*Primary Examiner*—William H. Schultz
*Attorney, Agent, or Firm*—Berger & Palmer

[57] ABSTRACT

A stand for sheet music and the like comprises a first leg having a longitudinally extending non-circular bore open at one end, a shaft having a cross section corresponding to said bore and slidable therein through said open end, a pair of additional legs pivotally secured to the first leg at a substantially common location for movement between a collapsed position wherein the legs are aligned with the first leg and an open position wherein the additional legs extend outwardly from the first leg and the three legs collectively define a pyramidal base. The stand also includes a support for the sheet music and means for securing the support to the free end of the shaft for movement between a collapsed position wherein the support is aligned with the first leg and an open position wherein the support extends beyond the free end of the shaft and the weight of the support is distributed about the vertical axis of the base.

8 Claims, 6 Drawing Figures

COLLAPSIBLE STAND FOR SHEET MUSIC AND THE LIKE

BACKGROUND OF THE INVENTION

1. Field of the Invention

This invention pertains to stands for supporting sheet music, books, or the like and more particularly to stands of the type mentioned which are collapsible for storage.

2. Statement of the Prior Art

In one commercially available collapsible music stand known to applicant, a pair of elongate telescoping cylindrical members is arranged to extend vertically upward from the apex of a pyramidal base defined by three collapsible legs. The holder for the music, which is comprised of a plurality of radially extending members pivotally secured to the top of the upper cylindrical member and joined together by a plurality of foldable struts, is also collapsible. In the collapsed position, the legs extend downwardly from the lower cylindrical member and the arms and struts of the music support extend upwardly from the upper cylindrical member.

Apart from being heavy and somewhat bulky in the collapsed position, the above-described music stand is somewhat unstable due to the fact that the music holder and any music placed thereon are offset from the center of gravity of the base.

Other prior art stands for supporting sheet music, books and the like are disclosed in U.S. Pat. Nos. 115,886, 2,046,134 and 3,868,085.

SUMMARY OF THE INVENTION

According to the invention, I have developed a stable, lightweight, structurally sound stand for sheet music and the like which may be collapsed for carrying or storage. The components of my preferred stand comprise a first leg of triangular cross section having a triangular shaped longitudinally extending bore open at one end. A triangularly shaped shaft is slidable within the bore through the open end and a pair of additional legs are pivotally secured to one end of the first leg near the top thereof for movement between a collapsed position wherein each additional leg confronts one face of the first leg and an open position wherein the additional legs extend outwardly from the first leg and the three legs collectively define a pyramidal base.

A support for the sheet music is pivotally secured to the upper end of the shaft. The support preferably comprises a plurality of arms pivotally secured together at one end for movement between a collapsed position wherein the arms are aligned and an open position wherein the arms are out of alignment for defining a support surface for the sheet music. Preferably, a knotted flexible member, such as nylon cord or the like, extends through apertures in the arms for limiting movement of the arms to the open position.

The support itself is pivotally secured to the free end of the shaft for movement between a collapsed position wherein the support is aligned with the remaining face of the first leg when the arms are collapsed and the shaft is substantially fully received in the bore, and an open position wherein the support extends beyond the free end of the shaft. In the open position, the weight of the support is distributed about the vertical axis of the pyramidal base defined by the three legs.

It will be apparent from the above that when the stand is open for use it will exhibit good stability due in part to the fact that the weight of the support and the materials placed thereon will be distributed over the vertical axis of the base. In addition, the shaft and the support secured thereto are prevented from rotating relative to the base by the non-circular cross sections of the bore and shaft.

Further features and advantages of the stand for sheet music and the like according to the present invention will become more fully apparent from the following detailed description and annexed drawings of the preferred embodiment thereof.

DETAILED DESCRIPTION OF THE PREFERRED EMBODIMENT

Figures 1, 2, 3, 4, 5, 6:
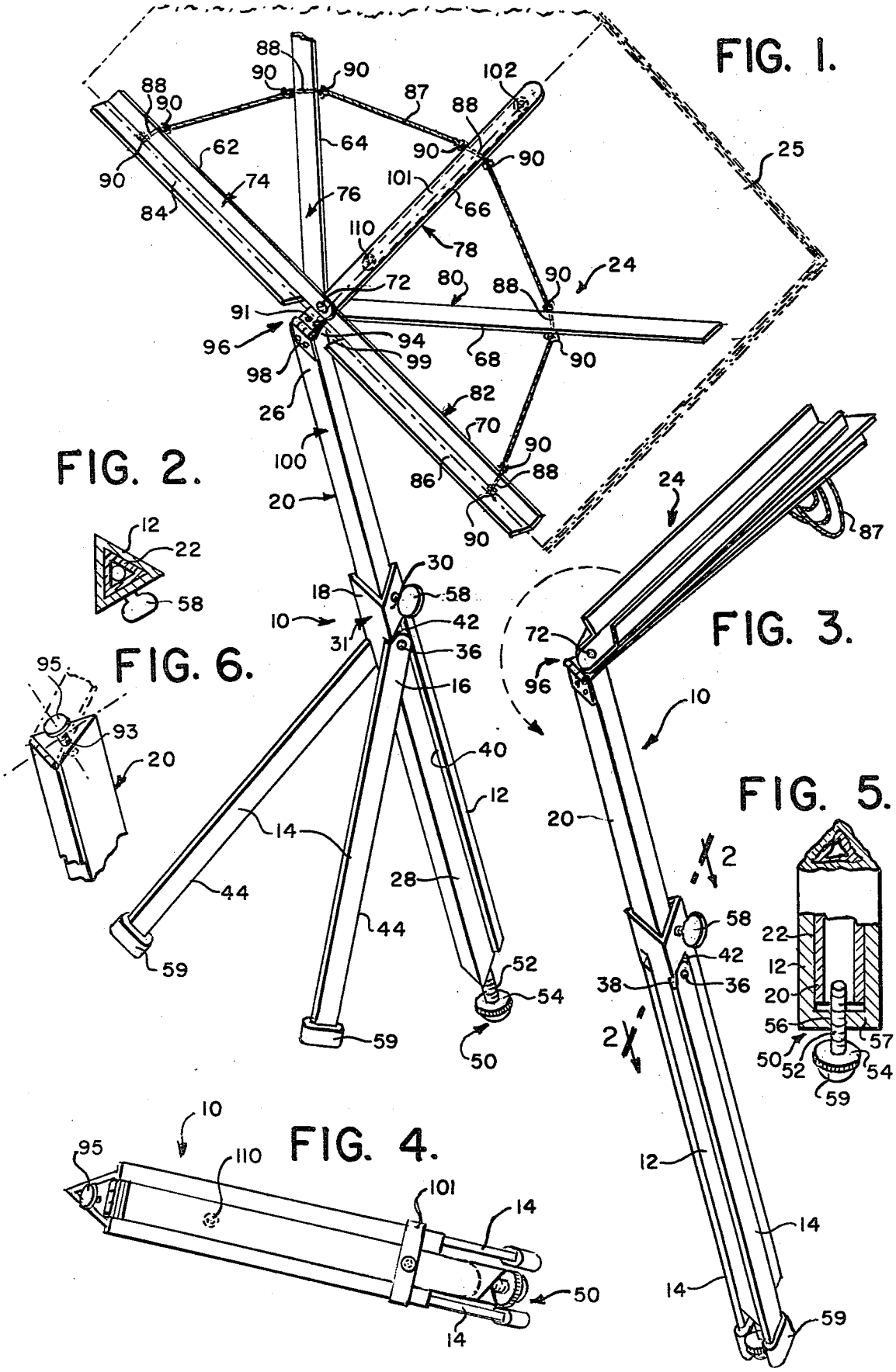
FIG. 1 is a perspective view of the preferred stand according to the present invention in the open position.
FIG. 2 is a sectional view taken substantially along the line 2—2 in FIG. 3.
FIG. 3 is a perspective view of the stand of FIG. 1 shown partially collapsed.
FIG. 4 is a perspective view of the stand of FIG. 1 shown fully collapsed.
FIG. 5 is a fragmentary perspective view, partially broken away, showing the details of the extensible member secured to the bottom of the main leg of the stand of FIGS. 1–4.
FIG. 6 is a fragmentary perspective view, partly in phantom, showing the details of the extensible member secured to the top of the telescoping shaft.

Referring now to FIGS. 1–5 in the drawings, the preferred stand for supporting sheet music or the like in accordance with the present invention is designated by the reference numeral 10. As illustrated, the principal components of the stand 10 are a first leg 12 having a longitudinally extending bore 22, a pair of legs 14 pivotally secured at one end 16 to the upper end 18 of the leg 12, a shaft 20 dimensioned for telescoping in the bore 22, and a support 24 for sheet music 25 or the like pivotally secured to the upper end 26 of the shaft 20.

The cross section of the bore 22 and the corresponding cross section of the shaft 20 may vary, although they should be non-circular to prevent relative rotation between the shaft 20 and the leg 12 when the stand 10 is opened for use (FIG. 1). Thus, as best shown in FIG. 4, the cross sections of the shaft 20 and the bore 22 are preferably triangular. For reasons that will be more fully apparent hereinafter, the peripherally extending wall of the leg 12 which defines the bore 22 is also preferably triangularly shaped.

The pair of legs 14 together with the leg 12 define the base of the stand 10. Like the shaft 20 and the member 12, the configuration of the legs 14 may vary. However for reasons that will be apparent hereinafter, the legs 14 are preferably substantially flat and somewhat longer than the leg 12. Although the legs 14 may be pivotally secured to the upper end 18 of the leg 12 in a number of ways, many of which will immediately suggest themselves to those skilled in the art, the means shown in the drawings is preferred. Thus, and as best shown in FIG. 1, the legs 14 are preferably pivotally secured in rectangular recesses 28 provided in two faces 30 of the leg 12. Each of the recesses 28 is open at the bottom and on one side and is dimensioned to receive substantially the full length of one of the legs 14 when the legs 14 are in the collapsed position (FIG. 3). The legs 14 are preferably pivotally secured in the recesses 28 by rivets 36 or the like which extend through the legs 14 into the leg 12. As preferred and shown, to prevent movement of the legs 14 beyond the open position, the upper ends of the legs 14 are provided with bevelled edges 38 which abut the upper defining walls of the recesses 28 when the legs 14 are opened (FIG. 1). Likewise, movement of the legs 14 beyond the collapsed position (FIG. 3) is restricted by the upper walls and side walls 40 of the recesses 28 which abut, respectively, the top edge 42 and side edges 44 of the legs 14.

The leg 12 preferably includes means for varying the length of the leg 12 so that the stability of the stand 10 may be adjusted. While various arrangements are possible, this is preferably accomplished by a member 50 secured to the lower end of the leg 12 for axial movement relative thereto. As best shown in FIG. 5, the member 50 comprises a threaded bolt 52 having a disc-shaped foot 54 at one end thereof. The bolt 52 is received in a threaded hole 56 in the bottom 57 of the leg 12. It will therefore be apparent that by rotating the foot 54, the distance of the foot 54 from the bottom 57 of the leg 12 may be varied whereby the overall length of the leg 12 may be adjusted. When this arrangement is used, the shaft 20 should be hollow whereby the bolt 52 may be received in the hollow of the shaft 20 when the shaft 20 is received in the leg 12 (FIG. 5). Preferably, rubber feet 59 are secured to the bottom of the legs 14 and the disc 54 to reduce the tendency of the stand 10 to slide on the floor or other supporting surface.

While numerous arrangements may be used for adjusting the height of the shaft 20, it is presently preferred to employ the arrangement shown in the drawings. Thus, a threaded bolt 58 having an enlarged head is received in a threaded thru-hole (not shown) in one face 30 of the leg 12. It will be apparent that the position of the shaft 20 may be fixed by rotating the bolt head to tighten the bolt against the shaft. In an alternative arrangement, a longitudinally extending slot may be provided in the top of the leg 12 in one face 30. A releasable clamp secured to the other two faces of the leg 12 could then be used to compress the slot which, in turn, would sufficiently reduce the size of the bore 22 to prevent free sliding movement of the shaft 20 in the bore.

As best shown in FIG. 1, the support 24 preferably comprises a plurality of arms, here shown to be five arms 62, 64, 66, 68 and 70, pivotally secured together at one end as by a rivet 72 which extends through the arms at their connected ends. The arms 62, 64, 66, 68 and 70 preferably include flat surfaces 74, 76, 78, 80 and 82, respectively, whereby when the holder 24 is in the open position, the flat surfaces collectively define a substantially planar surface for the sheet music 25 or other materials to be supported. The outermost arms 62 and 70 have portions 84 and 86, respectively, which extend perpendicularly from the plane defined by the surfaces 74, 76, 78, 80 and 82 and serve as a rest for the materials. Because it is desirable to keep the overall weight of the stand 10 as light as possible, the arms 62, 64, 66, 68 and 70 are preferably fixed in their open positions by a flexible cord 87 made of nylon or the like which extends through apertures 88 in the arms. As shown, the cord 87 has a plurality of knots 90, one on either side of each aperture 88. The knots 90 are larger than the apertures 88 and are spaced to prevent movement of the arms beyond their open positions.

As noted above, the holder 24 is pivotally secured to the upper end 26 of the shaft 20 for movement between an open position (FIG. 1) and a collapsed position (FIG. 4). While the holder 24 may be secured to the shaft 20 for the requisite pivotal movement in a variety of ways, the arrangement best illustrated in FIGS. 1 and 6 is preferred. Thus, the middle arm 66 of the holder 24 is provided with an extended portion 91 at its connected end which portion is fixedly secured, as by rivets, to one plate 94 of a hinge 96. As shown, the other plate 98 of the hinge 96 is fixedly secured to the face 100 of the member 20 as by additional rivets. The top of the shaft 20 is closed and angled such that the plane defined by the top of the shaft is at about a 45° angle with respect to the horizontal when the stand 10 is in the open position (FIG. 1). A threaded hole (not shown) in top of the shaft 20 receives the free end of a threaded bolt 93 which is connected at its other end to a disc-shaped member 95. Preferably, the top of the member 95 is comprised of rubber or the like. It will thus be apparent that when the hinge 96 is in the open position (FIGS. 1 and 6), the plate 94 seats on top of the member 95 and that by rotating the bolt 93 the distance of the member 95 from the top of the shaft 20 may be varied whereby the angle of the plane defined by the surfaces 74, 76, 78, 80 and 82 with respect to the horizontal may be adjusted.

Those skilled in the art will appreciate that the rigid parts of the stand 10, such as the legs 12 and 14, the shaft 20 and the arms 62, 64, 66, 68 and 70, may be comprised of a variety of rigid materials such as metals and their alloys. However, to keep the stand 10 as light as possible, the metal or metal alloy employed should be light. Aluminum is presently preferred.

The method of carrying out the steps for collapsing the stand 10 from the open position (FIG. 1) may vary. By way of example, and referring to FIGS. 3 and 4, the stand 10 may be collapsed by first collapsing the legs 14 into the recesses 28. The arms 62, 64, 66, 68 and 70 of the holder 24 may next be collapsed together whereupon the bolt 58 may be loosened and the shaft 20 slid into the bore 22 in the leg 12. The bolt 58 may then be retightened to hold the shaft 20 in the collapsed position. At this point, the hinge plate 94 is pivoted until it overlies the other hinge plate 98 in which position the arms 62, 64, 66, 68 and 70 confront the face 31 of the leg 12 (FIG. 4). It will be apparent that when the stand 10 is in the collapsed position (FIG. 4), the portions 84 and 86 of the arms 62 and 70 confront the faces 30. Accordingly, and as best shown in FIG. 1, a space 99 is provided between the portion 86 and the leg 12 to accommodate the bolt 58 which extends through the face 30 confronted by the portion 86. As shown, a similar space is provided between the portion 84 and the leg 12 to maintain symmetry.

While numerous means may be devised for holding the legs 14 and the arms 62, 64, 66, 68 and 70 in the collapsed position, this is preferably accomplished by employing a strap 101 fixedly secured as by a rivet 102 to the back of the free end of the middle arm 66. A male portion (not shown) of a snap extends upwardly from the top of the rivet 102 and a female portion (not shown) of the snap is secured to the other end of the strap 101 on the side opposite the male portion. Thus, when the legs 14 and arms 62, 64, 66, 68 and 70 are collapsed, the strap 101 may be wrapped around the legs 12 and 14 and the arms 62, 64, 66, 68 and 70 whereupon the female portion of the snap may be snapped onto the male portion (FIG. 4). It will be apparent that in this position accidental opening of the legs 14 or of the arms 62, 64, 66, 68 and 70 is prevented. As presently preferred and best shown in FIG. 4, an additional male portion 110 of the snap is provided on the lower back of the arm 66 so that the female portion of the snap may be secured thereto for holding the strap 101 neatly in place when the stand 10 is open for use.

It will thus be apparent that the stand of the invention, which is both lightweight and sturdy when open, may be collapsed to a highly compact position for storage.

Once the above description of the preferred music stand 10 in accordance with the present invention is known, it will be apparent that numerous changes and modifications may be made without departing from the spirit and scope of the invention. For example, telescoping members in addition to the shaft 20 may be added to the stand 10 to increase its maximum height. Likewise, the legs 12 and 14 could themselves be telescoping whereby the collapsed size of the stand 10 may be further compacted. Collapsible struts or additional nylon cords or the like may be connected between the leg 12 and the legs 14 for preventing movement of the legs 14 beyond their open positions. These struts or cords could replace or supplement the arrangement illustrated in the drawings for preventing movement of the legs 14 beyond their open positions. It will be further apparent that the raised portions of the faces 30 of the leg 12 which define the walls 40 may be eliminated in which case the legs 14 will still be prevented from moving beyond their closed positions by the abutment of the top edges 42 of the legs 14 with the upper walls of the recesses 28 and, if used, by the strap 101. Also possible is the replacement of the member 50 by a telescoping member whose axial position relative to the leg 12 could be controlled, for example, by a bolt similar to the bolt 58 extending through the face 31 of the leg 12.

Also, while it is preferred and shown that the legs 14 are pivoted to the leg 12 at the upper portion thereof, this is not absolutely necessary and arrangements wherein the legs 14 are pivoted to the leg 12 at or near its midpoint may be devised. However, such arrangements will not have the stability of the preferred stand 10.

In many situations, it may be desirable to write on the music stand 10 when it is opened. The holder 24 of FIGS. 1–5 does not provide a surface suitable for this purpose. This may be rectified by adding a plurality of additional cords arranged in parallel to the cord 87 such that the cords collectively define a supporting surface suitable for writing. Another possibility is to glue a sheet of flexible material to the arms which define the holder 24. The piece of flexible material would have pre-formed fold lines in the manner of a folding fan. This would prevent destruction of the flexible material upon collapse of the holder 24.

Since these as well as additional changes and modification are intended to be within the scope of the present invention, the above description should be construed as illustrative and not in a limiting sense, the scope of the invention being defined by the following claims:

I claim:

1. A stand for sheet music and the like comprising:

a first leg having a longitudinally extending non-circular bore open at one end;

a shaft having a cross section corresponding to said bore, said shaft being slidable within said bore through said open end;

a pair of additional legs pivotally secured to said first leg at a substantially common location for movement between a collapsed position wherein said additional legs are substantially aligned with said first leg and an open position wherein said additional legs extend outwardly from said first leg and said three legs collectively define a generally pyramidal base;

a support including a plurality of arms pivotally secured together at one end, said arms being movable between a collapsed position wherein said arms are substantially aligned and an open position wherein said arms are out of alignment for defining a supporting surface for said sheet music and the like; each of said arms having an aperture therein and further comprising a knotted flexible member secured to said support and extending through said apertures, said knots being larger than said apertures and spaced for holding said arms in said open position; and means for securing said support to the free end of said shaft for movement between a collapsed position wherein said support is substantially aligned with said first leg when said arms are collapsed and said shaft is substantially fully received in said bore, and an open position wherein said support extends beyond the free end of said shaft and the weight of said support is distributed about an axis extending through said common location and perpendicular to the horizontal when said arms are in said open position.

2. The stand of claim 1, wherein said first leg, said bore and said shaft have substantially triangular cross sections.

3. The stand of claim 2, wherein said additional legs are substantially flat and each confronts one face of said first leg when said additional legs are in said collapsed position.

4. The stand of claim 3, wherein said faces of said first leg confronted by said additional legs have recesses therein and wherein said additional legs are received in said recesses when said additional legs are collapsed.

5. The stand of claim 3, wherein said support confronts the remaining face of said first leg when said support is in said collapsed position.

6. The stand of claim 1, wherein said connecting means comprises a hinge having one plate fixedly secured to said shaft adjacent the free end thereof and the other plate fixedly secured to said support adjacent the secured ends of said arms.

7. The stand of claim 6, further comprising a member secured to the free end of said shaft for movement relative to said shaft at an angle with respect to the axis thereof, and wherein said other plate seats on said member when said support is in said open position whereby the angle of said supporting surface with respect to the horizontal may be varied by moving said member.

8. The stand of claim 1, and further comprising a member secured to the other end of said first leg for axial movement relative thereto.

* * * * *